US005291807A

United States Patent [19]

Vanderford et al.

[11] Patent Number: 5,291,807

[45] Date of Patent: Mar. 8, 1994

[54] PATTERNED HARDFACING SHAPES ON INSERT CUTTER CONES

[75] Inventors: William D. Vanderford, Irving; Alan D. Huffstutler, Grand Prairie, both of Tex.

[73] Assignee: Dresser Industries, Inc., Dallas, Tex.

[21] Appl. No.: 926,377

[22] Filed: Aug. 10, 1992

Related U.S. Application Data

[62] Division of Ser. No. 667,699, Mar. 11, 1991, abandoned.

[51] Int. Cl.[5] ..... B21K 5/02

[52] U.S. Cl. ..... 76/108.2; 76/DIG. 11; 76/DIG. 12

[58] Field of Search ..... 76/108.2, 108.1, 108.4, 76/DIG. 11, DIG. 12

[56] References Cited

U.S. PATENT DOCUMENTS

| | | | |
|---|---|---|---|
| 2,898,089 | 5/1955 | Hammer | 255/323 |
| 3,461,983 | 8/1969 | Hudson et al. | 175/375 |
| 3,513,728 | 5/1970 | Hudson et al. | 76/108 |
| 3,952,815 | 4/1976 | Dysart | 175/374 |
| 4,396,077 | 8/1983 | Radtke | 175/329 |
| 4,460,053 | 7/1984 | Jurgens et al. | 175/329 |
| 4,505,342 | 3/1985 | Barr et al. | 175/329 |
| 4,593,776 | 6/1986 | Salesky et al. | 175/375 |
| 4,630,692 | 12/1986 | Ecer | 175/330 |
| 4,640,375 | 2/1987 | Barr et al. | 175/410 |
| 4,679,640 | 7/1987 | Crawford | 175/374 |
| 4,725,098 | 2/1988 | Beach | 299/79 |
| 4,781,770 | 11/1988 | Kar | 148/16.5 |
| 4,814,234 | 3/1989 | Bird | 428/564 |
| 4,867,015 | 9/1989 | Kane et al. | 76/108.2 |
| 4,949,598 | 8/1990 | Griffin | 76/108.2 |

*Primary Examiner*—Roscoe V. Parker
*Attorney, Agent, or Firm*—Daniel R. Alexander

[57] ABSTRACT

A drill bit including at least one rolling cutter body with rows of relatively hard substantially outwardly projecting and circumferentially spaced cutting inserts projecting from the cutter body and having effective erosion reducing features by application of hardfacing materials placed in oriented regular patterns and shapes on designated critical and vulnerable cutter body areas. The cutter body is produced by a method wherein the body is marked in specific locations of desired patterns, shapes, or boundaries, and, then, hardfacing is applied in these specific boundaries to avoid the insert hole locations. After the hardfacing is permanently bonded to the specified areas, the holes are drilled and the hard cutting inserts are pressed into the holes.

8 Claims, 4 Drawing Sheets

PATTERNED HARDFACING SHAPES ON INSERT CUTTER CONES

This application is a division of application Ser. No. 07/667,699 filed Mar. 11, 1991 and now abandoned.

BACKGROUND OF THE INVENTION

The present invention relates to drill bits having inserts pressed into one or more cutter members or cones and, more specifically, it concerns a rock bit having hardfaced wear protection on the cutter members.

During the drilling of boreholes, rock bit cutter members constantly operate in a highly abrasive environment. This abrasive condition exists during drilling operations wherein either a drilling mud, air, or gas is utilized as the medium for cooling, circulating, flushing, and carrying the cuttings from the borehole.

Drill bit life and efficiency are of prime importance in the drilling of oil and gas wells, blast holes, raise holes or other types of boreholes since the penetration rate is related to the condition of the bit. When harder formations are encountered during drilling of the borehole, a bit having carbide inserts projecting from the body of each of the cutter members is generally utilized because of the ability of the inserts to penetrate the hard formations. However, the carbide inserts are mounted in a relatively soft metal that forms the body of each of the cutter members. The relatively soft metal cutter body which holds the inserts in place is abraded or eroded away relatively easily when subjected to the highly abrasive drilling environment. This abrasion or erosion is primarily due to the presence of relatively fine cuttings from the formation that have not been carried out of the borehole, the direct blasting effect of the fluid utilized in the drilling process, and the rolling or sliding contact of the cutter body or cone shell with the formation.

The wearing away of the cutter member body is usually most pronounced on the inner and outer edges of the lands of the cutter surface immediately adjacent the insert and the groove between one row of inserts and another on the cutter member. For every two consecutive rows of inserts on a cutter member, one is considered the outer row, the other the inner row. The heaviest wear on the cutter member surface lands is usually most pronounced on the inner edges of the outer rows, and on the outer edges of the inner rows. Consequently, the innermost row on the cutter member will predominantly wear on the outer edge of the land, the gage row predominantly on the inner edge of its land, and the rows in between the two wear on both the inner and outer edges of their lands.

When the material supporting the inserts is eroded or abraded away to a sufficient extent, the drilling forces being exerted on the inserts when they engage the formation either break the inserts or force them out of the cutter member altogether with the result that the bit is no longer effective in cutting the formation.

When drilling many of the softer abrasive formations where the bit is able to penetrate at an extremely high rate, it can be expected that the individual cutting inserts can penetrate entirely into the abrasive formation causing the formation to come into contact with the cutter body or cone shell. When this cone shell contact occurs, the relatively soft cone shell material will erode away, namely at the edges of the surface lands, until the buried portion of the insert itself becomes exposed and the retention ability in the cone shell is reduced ultimately resulting in the loss of the insert and reduction of bit life.

The inserts are retained in the cutter member by the "hoop" tension generated when the insert is pressed into a drilled hole in the cutter member body. Accordingly, any method utilized in attempting to alleviate the erosion of the cutter member must take into consideration that the "hoop" tension holding the insert must be retained.

U.S. Pat. Nos. 3,461,983 and 3,513,728 issued to Lester S. Hudson and Eugene G. Ott disclose a drill bit having a plurality of cutter members with hard inserts in holes surrounded by hardfacing. These patents describe a method of manufacturing the drill bit wherein holes are drilled in the cutter members and, then, the holes are plugged and the hardfacing material is applied to the surface around the plug. After the hardfacing material has been permanently bonded to the surface, the plugs are removed and the hard inserts are pressed into the holes to complete the apparatus.

It has been found that the method described in the above-mentioned patents is impractical because of the tedium and the economics of placing plugs into the numerus holes on a cutter member. In addition, it was also found that the heating process which bonds the hardfacing to the member surface caused the preformed holes to warp or otherwise become out of round. This out of roundness lead to an inconsistency in the "hoop" tension that holds the inserts in the cutter member and ultimately to the loss of inserts.

It also has been found impractical to press the inserts into the cutter before applying the hardfacing since the utilization of heat to adhere the hardfacing material to the surface of the cutter member relieves the "hoop" tension in the cutter member.

Previous attempts to hardface cutter members before drilling the holes lead to difficulty since the hardfacing was placed on the cutter member surface where the inserts were to be located. Penetrating this hardfacing material proved to be difficult and impractical. Even when holes were successfully drilled through the hardfacing material, pressing the inserts into the holes resulted in cracks in the cutter member immediately surrounding the inserts. The cracks relieved the "hoop" tension so that the inserts were not retained adequately.

Certain cutter shell areas were not expected to experience wear because it was thought that during normal drill bit operation the cutter shell would not come into contact with the abrasive formation. However, with the increased use of tooth-shaped insert bits for use in softer formations where the full insert extension penetrates entirely into the formation, this expectation is not applicable. Current high penetration rates with these types of insert bits have made cutter shell erosion an increasingly significant factor in limiting bit life.

In light of the foregoing, an economical, uncomplicated, and aesthetically pleasing method of protecting the vulnerable cutter shell is sorely needed.

SUMMARY OF THE INVENTION

The present invention alleviates cutter shell abrasion and erosion on a rock bit by judicious placement of wear-resistant materials with oriented regular patterns in designated critical and vulnerable cutter shell areas while maintaining the "hoop" tension needed to retain the inserts.

In accordance with an exemplary embodiment of the present invention, a rock bit having a plurality of rolling cutter members each having rows of outwardly projecting and circumferentially spaced cutting inserts is produced by an improved method wherein before the insert retaining holes are drilled in the cutter body, areas of probable cone shell wear are determined either by use of templates or more preferably automatically by N/C tape on a milling machine. The hole locations and spacing are pinpointed such that oriented regular shaped patterns where hardfacing is to be applied are identified by marking, etching or masking the cutter surfaces to avoid application where the holes are to be drilled. After this pattern identification is complete, the hardfacing is applied staying within the boundaries marked. Then, the holes are drilled after the cones have been quenched. The first hole is aligned between the hardfacing in proper spacing sequence and, thereafter, the holes are drilled automatically by N/C tape machine. With this method, any imaginable pattern of hardfacing can be applied to the cutter body and yet avoid the insert hole locations.

In a preferred embodiment of the invention, to protect the thin section of relatively soft metal that remains between the edge of the groove and the wall of the drilled hole in the cutter body, a band of hardfacing is applied on the inner and outer edges of the cutter body grooves which lead to the edge of the land surface where the insert cutter holes are to be drilled. Additionally, semi-circular hardface patterns on the inner and outer edges of the cutter lands adjacent the insert hole locations protect these edges from wearing down and prevent erosion from around the insert cutters.

Because of the variations in the types of formations to be encountered and the varying degrees of bit offset available, some cutter members will experience a large amount of cutter sliding action in contact with the formation while others will experience a lesser amount. Herein lies a great advantage of this invention, the ability to choose where and how much hardfacing is to be applied, and, thereby, reduce the cost of protection.

Another advantage of the invention is that the hardfacing can easily be kept a safe distance from the insert cutter holes since any hardface application too close to the holes may cause cracking when the insert is forced into the hole. In the preferred embodiment, this distance is a minimum of 1/16 of an inch, and only in one location on each side of the hole as will be described later in detail.

In accordance with the present invention, the "hoop" tension is retained, the cutter body is quenched to bring the relatively soft cutter body hardness up, many variations in pattern styles and orientation are achieved, and hardface protection is provided in a fast, simple, and cost-effective manner.

It is, therefore, an object of the invention to provide an improved apparatus useful in abrasive environments having a hard insert element in a cutter body and having hardfacing materials applied in an oriented pattern in critical and vulnerable areas on the cutter body to prevent erosion of the valuable cutter shell and, thereby, retain the insert elements.

It is also an object of the invention to provide an improved method of manufacturing an apparatus useful in an abrasive environment including a cutter body having hardfaced surfaces and at least one insert element of harder material than the cutter body forced into a preformed hole on a land surface.

Another object of the invention is to provide a method of manufacturing a cutter body having hard insert cutters and having hardfacing applied to surfaces adjacent the insert cutters in patterns such that there is no effect on the tension forces in the cutter body that retain the insert cutter.

Yet another object of the invention is to provide an improved rock cutting bit for use in drilling for oil and gas wells and that employs a plurality of hard insert cutters pressed into the cutter body of the bit and having hardfacing applied to the vulnerable and critical areas on the surface of the cutter body in oriented patterns to prevent the erosion of the cutter body and the subsequent loss of the insert cutters.

Other objects and further scope of applicability of the present invention will become apparent from the detailed description to follow taken in conjunction with the accompanying drawings in which like parts are designated by like referenced characters.

BRIEF DESCRIPTION OF THE DRAWINGS

FIG. 4-B is a sectional view as seen substantially from position 4B—4B of FIG. 4-A;

FIG. 4-C is the same view as FIG. 4-A with the hardfacing application stage of the present process completed;

FIG. 4-D is a sectional view as seen substantially from position 4D—4D of FIG. 4-C;

FIG. 4-E is the same view as FIG. 4-C with the insert retaining holes formed in proper alignment between the patterned hardfacing; and, FIG. 4-F is a sectional view as seen substantially from position 4F—4F of FIG. 4-E showing an insert located in its respective hole.

DETAILED DESCRIPTION OF THE INVENTION

Figure 1:
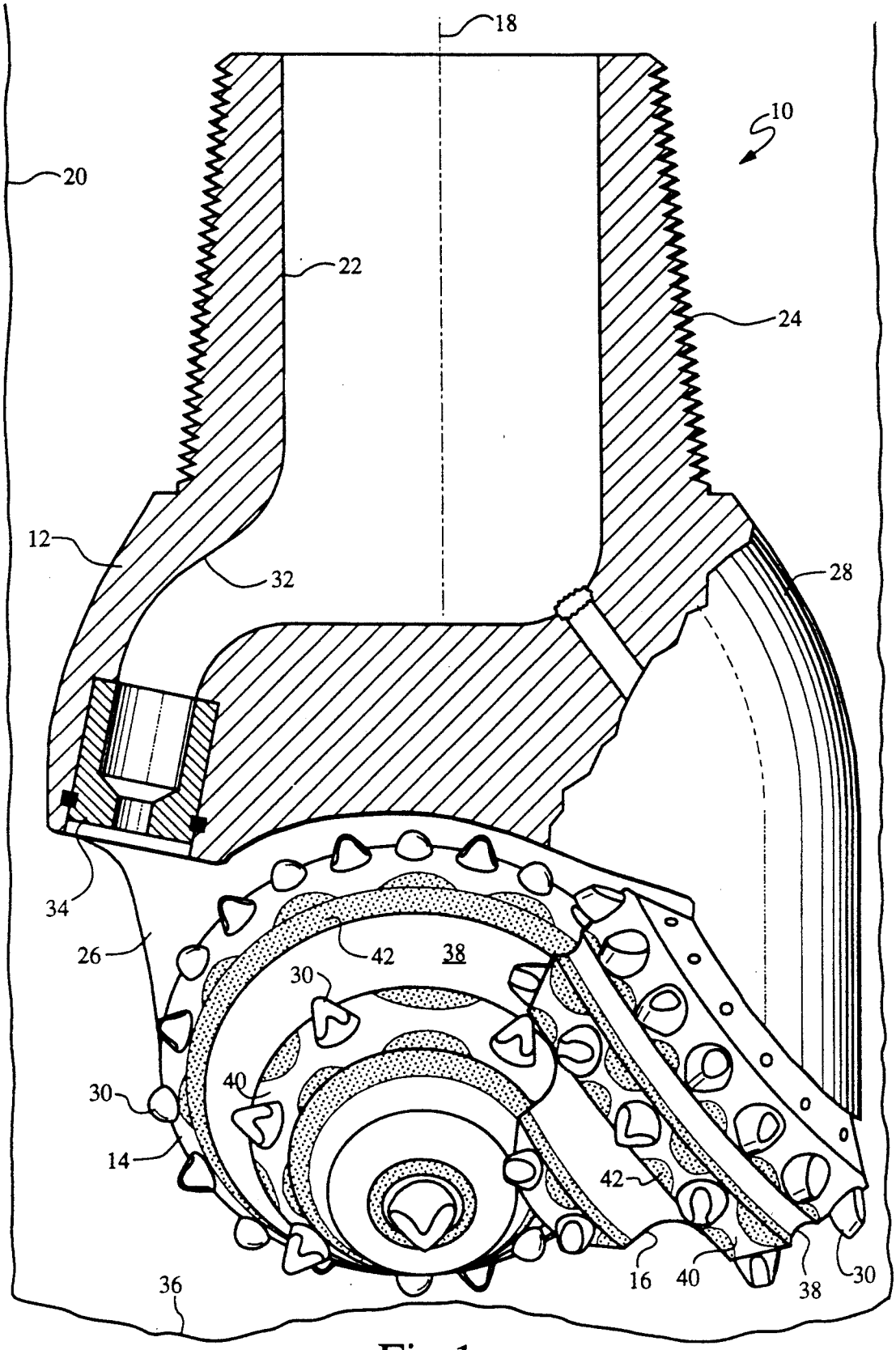
FIG. 1 is a partial cutaway perspective illustration of a three cone rolling cutter rockbit of the present invention in a borehole.
Figure 2:
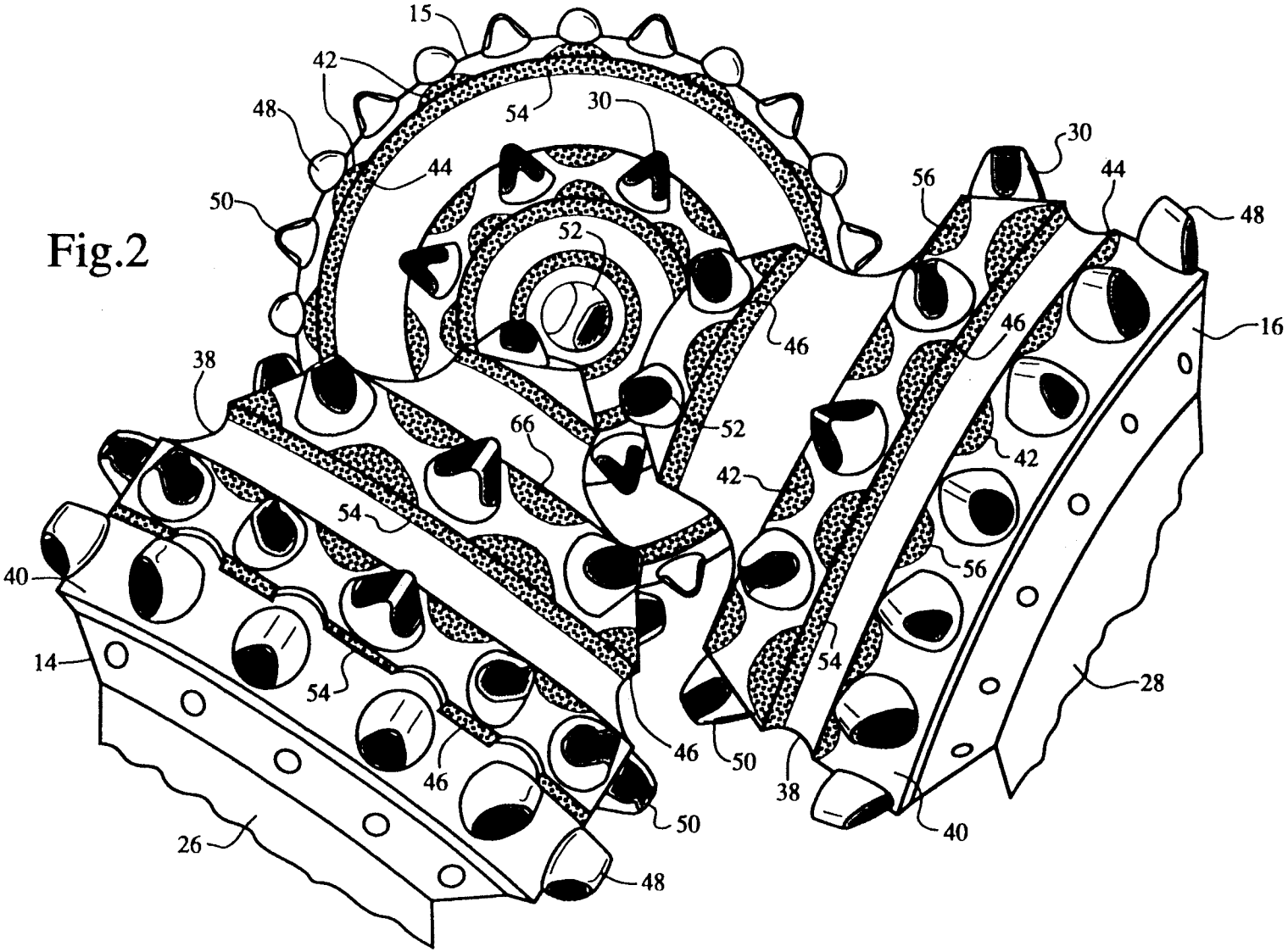
FIG. 2 is a cutaway perspective representation of the three rolling cone cutters of the rockbit of FIG. 1.

As shown in FIGS. 1 and 2 of the drawings, an earth boring bit generally designated by the reference number 10 includes a main bit body 12 supporting three rotatable conical cutter members 14, 15 and 16 with only two of the cutter members 14 and 16 being shown in FIG. 1. Each of the cutter members are arranged so that its axis of rotation is oriented generally toward the centerline 18 of the bit which coincides with the longitudinal axis of the borehole 20. A central passageway 22 extends downwardly into the bit body 12 along the centerline 18. The bit body 12 also includes an external threaded pin portion 24 for allowing the bit 10 to be connected to the lower end of a string of hollow drill pipe.

The bit body 12 includes three depending arms with only two of the arms 26 and 28 being shown. Each of the depending arms is provided with a journal portion and a bearing pin for rotatably supporting a respective cutter member in a conventional manner. Each of the three arms of the bit 10 terminates in a shirttail that is disposed in close proximity to the wall of the borehole 20.

As is well known in the art, each of the rotary cone cutting members includes an internal cavity for receiving its respective bearing pin. Bearing means are provided between each of the cone cutter members and the bearing pin within the internal cavity. The bearing means include a system of either friction or roller bearings and a system of ball bearings.

With reference again to FIGS. 1 and 2 of the drawings, a multiplicity of tungsten carbide inserts 30 are embedded in the outer surface of the cone cutting members 14, 15 and 16 for disintegrating the formations as the bit is rotated and moved downward. Drilling fluid is forced downward through the center of the hollow drill pipe, passing into the central cavity 22. Passages 32 divide the flow of fluid passing through the cavity 22 into three distinct streams. The streams flow downwardly through the passages 32 to nozzles 34 which direct the fluid between the cutters to the bottom 36 of the borehole 20, cleaning the borehole 20 and carrying the cuttings to the surface.

As might be expected, the cutters 14, 15 and 16 are subjected to the direct blast of fluid flowing through the nozzles 34 as well as the effect of the fluid deflected from the bottom of the borehole 36. Also, the cutter members 14, 15 and 16 are continuously running in the cuttings generated as the cutter members engage the borehole bottom 36. Thus, the cutter members are subjected to extremely abrasive and/or erosive conditions that tend to wear, erode and abrade the material forming the exterior or cone shell of the cutter members. The cone shells of the cutter members 14, 15 and 16 include grooves 38 and insert lands 40.

When drilling in relatively soft, abrasive formations where the bit is penetrating at a rapid rate, it can be expected that the abrasive formations will be in contact with the cone shells on the areas at the outer and inner edges of the insert lands 40, as well as between the inserts 30 due to the penetration depth of the individual carbide cutting inserts 30. When this cone shell contact occurs, the softer cone shell material will erode away next to the carbide inserts 30 until the inserts 30 become exposed enough that the retention ability in the cone shell is weakened, thus causing the loss of the inserts 30 and a reduction in bit life.

Conditions often exist where the pressure, volume, and weight of the circulating fluid is inadequate for flushing of the cuttings from the borehole. Under these conditions, the cuttings generated by the action of the bit on the bottom of the borehole are not efficiently removed and tend to fall back to the bottom until a time when regrinding by the bit reduces the individual particles to a size small enough to be lifted by the circulating fluid. It can readily be appreciated that the bit will be working in a bed of abrasive cuttings under these conditions.

As shown more clearly in FIG. 2 of the drawings, each of the cutter members 14, 15, and 16 is provided with a plurality of spaced, circumferential rows of inserts 30. The inserts are preferably formed from an extremely hard material, such as carbide. The inserts function is to penetrate and, to some extent, disintegrate the formations encountered by the bit during the drilling of the well borehole. Each of the cutter members 14, 15 and 16 includes a plurality of circumferential grooves 38 and lands 40 with the inserts 30 being located in the lands 40.

With reference to FIGS. 1 and 2 of the drawings, specific areas on each of the lands 40 and grooves 38 are applied with hardfacing material 42 by a process that will be described hereinafter. The provision of the hardfacing material 42 in the areas of the lands 40 and grooves 38 as will be described serves to increase the life and effectiveness of the bit by reducing the abrasion and/or erosion of the relatively soft cutter member material that supports the inserts.

Bits incorporating large amounts of bit offset will increase the degree of cutter sliding action in contact with the formation. With this extreme sliding action, the erosive wear on the cutter lands occurs at an accelerated rate. Referring now particularly to FIG. 2, the areas of major concern occur substantially at the inner 44 and outer 46 edges of the cutter lands 40 since this is where the least amount of cone shell section is found due to the limited space provided to allow for the next row of cutting inserts 30 on an adjacent cone. These areas can withstand little wear before exposing the inserts and reducing the retention ability of the cone. The edges formed by the junction of the lands 40 and grooves 38 will experience the most wear as follows: beginning at the gage row 48, the wear is most pronounced at its inner edge 44; each successive inner row 50 will experience the most pronounced wear on both the inner 44 and outer 46 edges; the final, or nose row 52 will experience the most pronounced or damaging wear on its outer edge 46.

Current bits with a large degree of bit offset and high penetration rates have made cone shell erosion a significant factor in limiting bit life. In accordance with the present invention, the disposition of hardfacing material in these specific/critical areas in patterns that accommodate the placement of the insert cutters and prevent wear of these edges provides a simple, economical, timely, and effective means of protecting the valuable cone shell material and, thereby, prevents the loss of inserts during drilling operations.

FIG. 2 illustrates the preferred embodiment of the disposition of a band 54 of hardfacing material on the edges of the grooves 38 and semi-circular patterns 56 of hardfacing on the edges of the lands 40 adjacent to the inserts 30. It will be understood that the greatest wear occurs on the inner edge 44 of the gage row 48 land 40; on the inner 44 and outer 46 edges of the inner row 50 lands 40; and on the outer edge 46 of the nose row 52 land 40.

Figure 3:
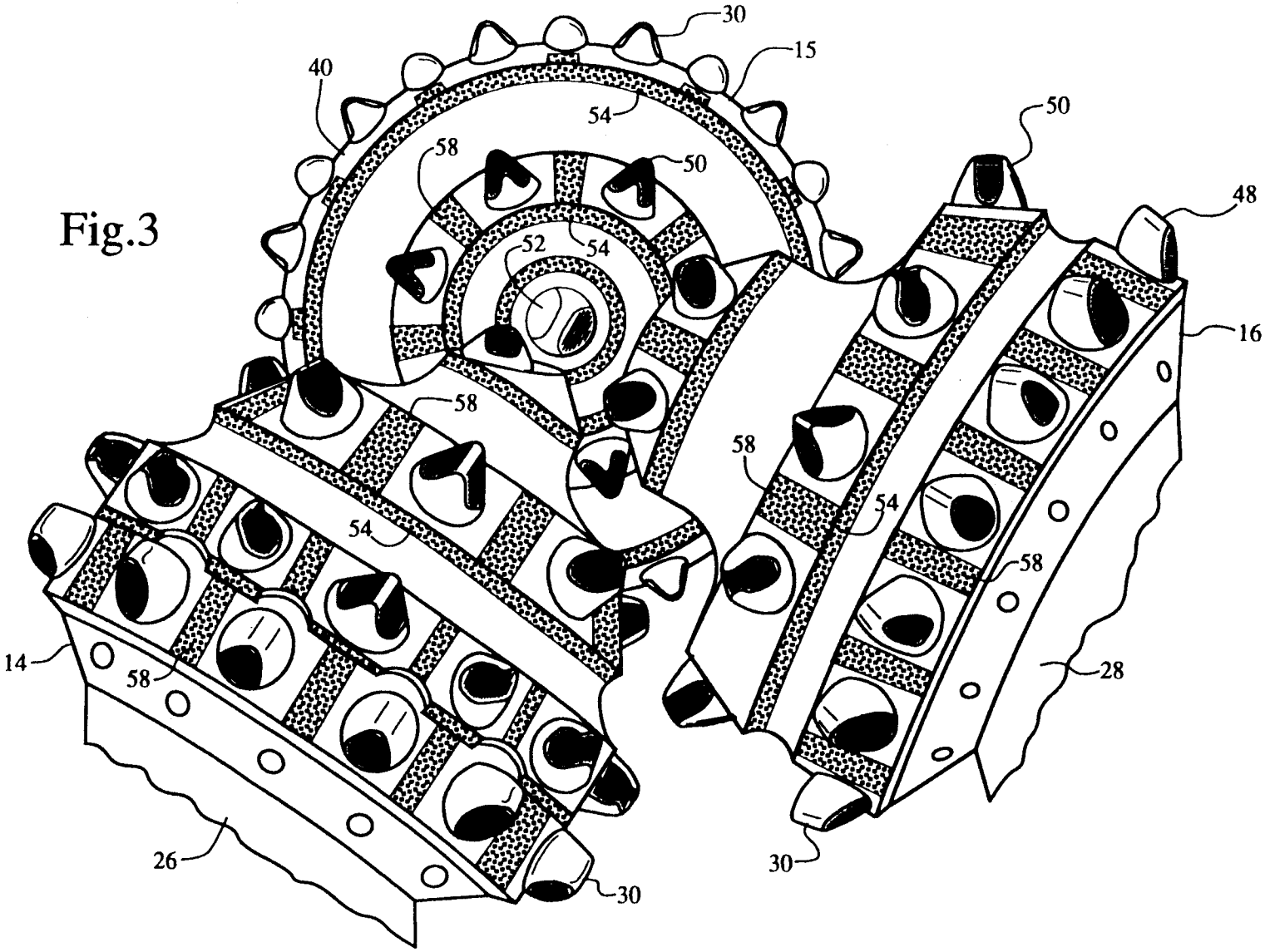
FIG. 3 is a cutaway perspective illustration of three rolling cone cutters in accordance with another embodiment of a rockbit of the present invention.
Figure 4A:
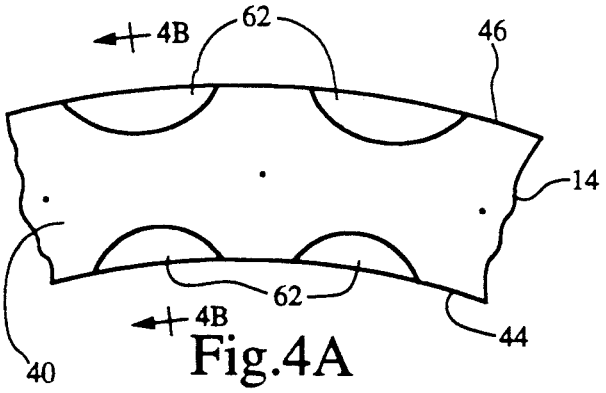
FIG. 4-A is a partial development view of a rockbit roller cone land with hardfacing locations and boundaries etched thereon in accordance with the first stage of the process of the present invention.
Figure 4B:
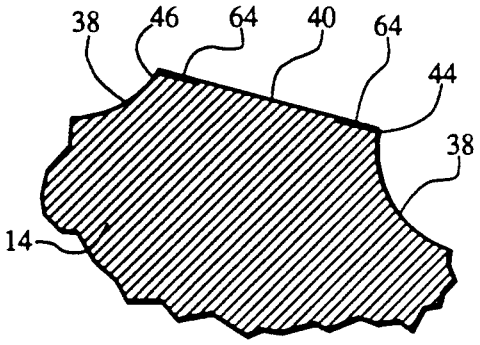
Figure 4C:
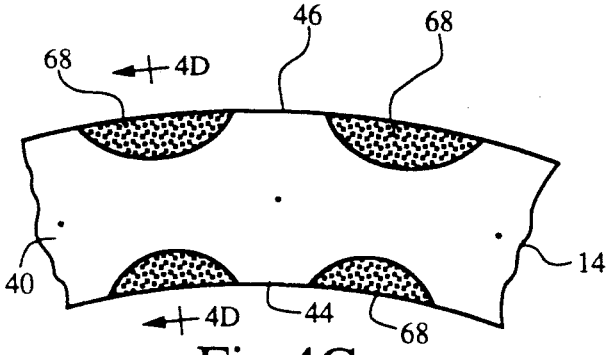
Figure 4D:
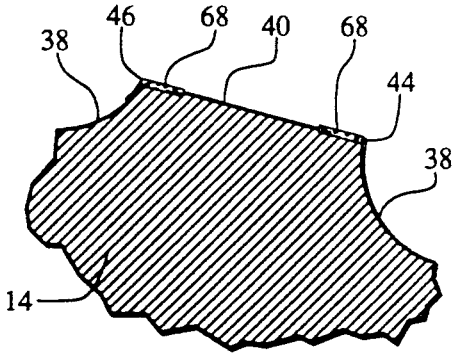
Figure 4E:
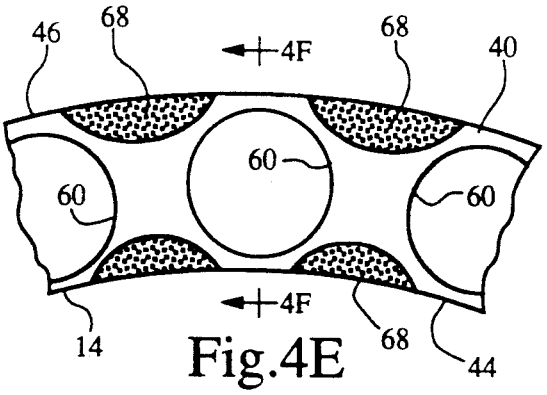
Figure 4F:
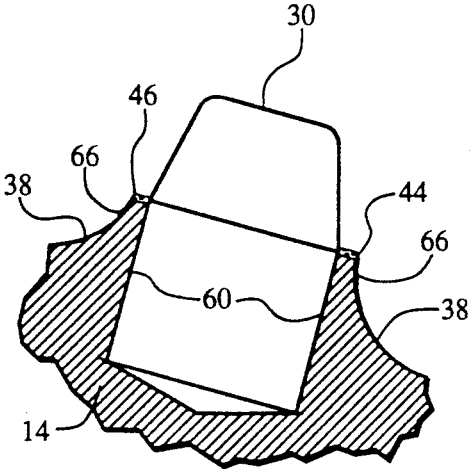

FIG. 3 illustrates another embodiment of a hardfacing pattern in accordance with the present invention wherein slot patterns 58 of hardfacing are located between the inserts 30 in the place of the semi-circular patterns 56 shown in FIG. 2. The cutter members 14, 15, and 16 of FIG. 3 are the same as those of FIGS. 1 and 2 with the exception of a variation in the hardfacing pattern.

As previously mentioned, the inserts 30 are retained in the cutter members 14, 15 and 16 by the "hoop" tension generated as the inserts are pressed therein. FIGS. 4-A through 4-F illustrate a method of the present invention utilized to successfully and economically protect the lands and grooves immediately adjacent the inserts without losing the "hoop" tension. Although FIGS. 4A–4F are directed to one of the lands 40 of the cutter member 14 having insert retaining holes 60, it is to be understood that the present method applies to all of the lands 40 on each of the cutter members 14, 15 and 16.

With reference to FIGS. 4A–4F of the drawings, the cutter members 14, 15, and 16 are machined to the desired configuration providing the lands 40 and grooves 38 after the inner bearing surface has been carburized. After machining, with the number and arrangement of the inserts predetermined, the pattern for the hardfacing of the lands 40 is marked, preferably with a numerically controlled (N/C) machine using conventional milling cutters and spacing (indexing) identical to that of the spacing of the insert holes 60. As shown in FIG. 4-A, the appropriate hardfacing pattern on the lands 40 is seen as semicircular shapes 62 etched into the land surface. The shapes are designed to maintain a minimum of 1/16" clearance from where the insert hole 60 will be. FIG. 4-B reflects a cross-sectional view which shows that the marking operation results in a relatively shallow depth of cut 64. At this point, the location of the band 66 of hardfacing material (See FIG. 4-F) on the edge of the groove 38 does not have to be etched into the cutter.

In place of etching or machining the hardfacing pattern, the lands 40 may be masked where the insert holes are to be drilled by a protective covering to be removed following the hardfacing application.

After the marking procedure is complete, the surface of the cutter member, that is, the surface of the lands 40 and grooves 38 are cleaned, preferably by heating. After cooling, the marked patterns 62 are painted with a bonding agent, such as a silicate, covering and staying within the areas marked, the bonding agent is also used to create the width of the circumferential bands 66 at the edge of the grooves 38 adjacent to the lands 40. A relatively fine particulate carbide 68 is then sprinkled on the silicate as shown in FIGS. 4-C and 4-D. Manifestly, any suitable type of hardfacing material can be utilized with or without a bonding agent as required.

When the silicate has dried, heat is applied to the hardfacing material 68 in any suitable manner, such as by the use of an atomic hydrogen or oxy-acetylene torch to permanently bond the hardfacing material 68 to the surface of the lands 40 and grooves 38.

Upon completion of the application of hardfacing material 68 and after the cutter member has been heat treated (quenched), the cutter member is aligned on a numerically controlled (N/C) drilling machine ½ pitch out of sink with the hardfacing patterns 62 pitching sequence, the holes 60 are automatically drilled in proper sequence, avoiding the hardfacing material. Then, the inserts 30 are pressed into the holes 60 by conventional means.

As can be seen in FIGS. 4-E and 4-F, the hardfaced patterns 62 protect the edges of the land 40 adjacent the holes 60. The patterns 62 and hole spacing are designed so that a minimum of 1/16" clearance is maintained between the pattern 62 and the edge of the hole 60 at their nearest point. The circumferential bands of hardfacing 66 are substantially ⅛" to ¼" wide and provide protection at the relatively thin section between the grooves 38 and the wall of the insert holes 60 (See FIG. 4-F).

The method described hereinbefore provides a means of hardfacing material application in patterns for specified critical and vulnerable areas of the cutter member lands 40 and grooves 38. The application economically prevents erosion and/or abrasion, yet does not destroy the ability of the cutter member to provide the tension force necessary to maintain the inserts 30 in their holes 60. By drilling the holes 60 in the cutter member after heat treating, the cutter member material hardness is increased without the risk of deforming or damaging the holes 60 which is critical in maintaining uniform "hoop" tension around the holes 60. At the same time, the foregoing procedure avoids the formation of stress around the insert holes.

Thus it will be appreciated that as a result of the present invention a highly effective drill bit and method is provided by which the principal object and others are completely fulfilled. It is contemplated and will be apparent to those skilled in the art from the foregoing description and accompanying drawing illustrations that variations and/or modifications of the disclosed embodiment may be made without departure from the invention. For example, a variety of patterns of hardfacing material may be applied to the upper surface of the lands 40 provided that there is sufficient distance between the insert holes 60 and the hardfacing to allow for the minimum preferred clearance of 1/16 of an inch between the hardfacing and the edge of the holes 60 at their nearest point. Accordingly, it is expressly intended that the foregoing description and accompanying drawings are illustrative of a preferred embodiment only, not limiting, and that the true spirit and scope of the present invention be determined by reference to the appended claims.

What is claimed is:

1. A method of manufacturing a rolling cone cutter member useful in erosive and abrasive environments, such as are encountered in drilling oil and gas wells and having a plurality of circumferentially spaced insert elements formed of a material harder than said cutter member located in respective insert receiving holes on a land surface of the cutter member and having wear resistant hardfacing material added to the cutter member in precise positions between the insert elements, comprising the steps of: determining the number and arrangement of insert elements on at least one land surface of a cutter member, etching boundaries for the deposition of hardfacing material on the cutter member with the boundaries defining a pattern of shapes of hardfacing material located between an spaced from the insert elements, placing hardfacing material within the etched boundaries, heat treating said cutter member, thereafter forming insert element receiving holes between the hardfacing material shapes, and forcing insert elements into the holes.

2. The method of claim 1 wherein the cutter member includes at least one groove surface adjacent the land surface and including a step of placing a continuous circumferential band of hardfacing material of substantial width on the groove surface adjacent the land surface prior to heat treating said cutter member.

3. The method of claim 1 wherein the insert receiving holes are formed maintaining at least 0.0625 of an inch distance from the hardfacing material shapes to the edge of the holes at their nearest interval.

4. The method of claim 1 wherein the pitch from center to center of adjacent hardfacing material shapes on the land surface is identical to the pitch from center to center of adjacent insert elements on the land surface, and wherein the step of etching the boundaries into said cutter member is accomplished using a numerically controlled machine which forms the insert element receiving holes in the cutter member by placing the cutter member on the machine one-half pitch out of sink with the hardfacing material shapes.

5. A method of manufacturing a rock bit useful in erosive and abrasive environments, such as are encountered in drilling oil and gas wells and including at least one cutter member having a plurality of circumferentially spaced insert elements formed of a material harder than said cutter member located in respective insert receiving holes on a land surface of the cutter member and having wear resistant hardfacing material added to the cutter member in precise positions between and spaced from the insert elements, comprising the steps of: determining the number and arrangement of insert elements on at least one land surface of a cutter member, etching boundaries for the deposition of hardfacing material with the boundaries defining a pattern of shapes of hardfacing material located between and spaced from the insert elements, placing hardfacing material within the etched boundaries, heat treating said cutter member, thereafter forming insert element receiving holes between the hardfacing material shapes, and forcing insert elements into the holes.

6. The method of claim 5 wherein the cutter member includes at least one groove surface adjacent the land surface and including a step of placing a continuous circumferential band of hardfacing material of substantial width on the groove surface adjacent the land surface prior to heat treating said cutter member.

7. The method of claim 5 wherein the insert receiving holes are formed maintaining at least 0.0625 of an inch distance from the hardfacing material shapes to the edge of the holes at their nearest interval.

8. The method of claim 5 wherein the pitch from center to center of adjacent hardfacing material shapes on the land surface is identical to the pitch from center to center of adjacent insert elements on the land surface, and wherein the step of etching the boundaries into said cutter member is accomplished using a numerically controlled machine which forms the insert element receiving holes in the cutter member by placing the cutter member on the machine one-half pitch out of sink with the hardfacing material shapes.

* * * * *